US007285025B2

(12) United States Patent
Denovich et al.

(10) Patent No.: US 7,285,025 B2
(45) Date of Patent: Oct. 23, 2007

(54) ENHANCED JACK WITH PLUG ENGAGING PRINTED CIRCUIT BOARD

(75) Inventors: Sam Denovich, Harrisburg, PA (US); James Joseph Eberle, Jr., Hummelstown, PA (US); Linda Ellen Bert, Camp Hill, PA (US); Michael P. Green, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/181,480

(22) Filed: Jul. 14, 2005

(65) Prior Publication Data

US 2007/0015414 A1 Jan. 18, 2007

(51) Int. Cl.
*H01R 24/00* (2006.01)

(52) U.S. Cl. ..... 439/676; 439/76.1

(58) Field of Classification Search ..... 439/76.1, 439/131, 676

See application file for complete search history.

(56) References Cited

U.S. PATENT DOCUMENTS 4,040,699 A * 8/1977 Rasmussen ..... 439/344
4,221,458 A * 9/1980 Hughes et al. ..... 439/545
4,497,526 A 2/1985 Myers
4,950,171 A * 8/1990 Muzslay ..... 439/76.1
5,696,660 A 12/1997 Price
5,702,271 A * 12/1997 Steinman ..... 439/676
6,146,184 A * 11/2000 Wilson et al. ..... 439/374
6,319,045 B1 * 11/2001 Sawayanagi et al. ..... 439/374
6,428,362 B1 * 8/2002 Phommachanh ..... 439/676
6,469,681 B1 * 10/2002 Jones et al. ..... 343/906
6,896,557 B2 * 5/2005 Aekins et al. ..... 439/676
6,988,900 B1 * 1/2006 Meister ..... 439/78

FOREIGN PATENT DOCUMENTS

JP 08250240 A 9/1996
JP 11008024 A 11/1999

OTHER PUBLICATIONS

Great Britain Patent Office Search Report for Application No. GB0613891.1 dated Oct. 18, 2006.

* cited by examiner

*Primary Examiner*—Thanh-Tam Le

(57) ABSTRACT

An electrical connector includes a housing, a printed circuit board (PCB), and a plurality of contacts. The housing includes a mating end and a wire receiving end. The PCB is mounted within the housing and has an opening formed therethrough. The plurality of contacts is configured to extend from the PCB. The opening is configured to receive a second electrical connector configured to mate with the electrical connector.

21 Claims, 5 Drawing Sheets

ENHANCED JACK WITH PLUG ENGAGING PRINTED CIRCUIT BOARD

BACKGROUND OF THE INVENTION

The invention relates generally to electrical connectors, and more particularly, to a connector that minimizes crosstalk among signal conductors in the connector.

In electrical systems, there is increasing concern for preserving signal integrity as signal speed and bandwidth increase. One source of signal degradation is crosstalk between multiple signal paths. In the case of an electrical connector carrying multiple signals, crosstalk occurs when signals conducted over a first signal path are partly transferred by inductive or capacitive coupling into a second signal path. This is sometimes referred to as negative coupling. The transferred signals produce crosstalk in the second path that degrades the signal routed over the second path.

For example, a typical industry standard type RJ-45 communication connector includes contacts that are planar in the mating region and physically long. The RJ-45 plug design is dictated by industry standards and is inherently susceptible to crosstalk. In conventional RJ-45 plug and jack connectors, all conductors extend closely parallel to one another over a length of the connector body. One pair of conductors is also split around another conductor pair. Thus, signal crosstalk may be induced between and among different pairs of connector conductors. The amplitude of the crosstalk, or the degree of signal degradation, generally increases as the frequency increases. More crosstalk can be created by the contacts in the jack that interface with the contacts in the plug. As signal speed and density increase, alien crosstalk (e.g., crosstalk between neighboring contacts and/or conductors) must also be addressed in preserving signal integrity at both the current Category 6 transmission frequency standard of up to 250 MHz, and at future (higher) transmission frequency standards.

At least some RJ-45 jacks include features separate from the signal contacts that are intended to suppress or compensate for crosstalk inherent to signals within a mating plug. However, the shortcomings that are inherent in jacks such as the RJ-45 can be expected to become more problematic as system demands (e.g., transmission frequencies) continue to increase. A connector that minimizes crosstalk as close as possible to the mating point of the plug contacts and jack contacts is needed rather than another connector that corrects for crosstalk after the signals have passed through the signal contacts.

Physical stability in the mechanical connection between a plug and jack can also be improved. In current configurations, the plug fits almost entirely within the jack. Contacts within one or more of the plug and jack are biased towards one another in an attempt to maintain good electrical contact between the respective plug and jack contacts. However, the housings for the jack and plug are typically configured for easy insertion and removal from one another, rather than for providing stability to the connection therebetween. Housings that improve the stability of the mechanical interconnection between a plug and jack are also needed.

BRIEF DESCRIPTION OF THE INVENTION

In one aspect, an electrical connector is provided. The electrical connector comprises a housing comprising a mating end and a wire receiving end, and a printed circuit board (PCB) mounted within the housing, the PCB comprising an opening formed therethrough. The electrical connector further comprises a plurality of contacts configured to extend from the PCB. The opening is configured to receive a second electrical connector configured to mate with the electrical connector.

In another aspect, a printed circuit board (PCB) configured for placement within a housing of an electrical connector is provided. The PCB comprises an opening formed therethrough and dimensioned for insertion of a portion of a second electrical connector, a plurality of contacts attached to the PCB and configured to extend into the opening, a plurality of circuit traces formed therein, and a plurality of wire receiving holes formed therein. The circuit traces extend from a respective contact to a respective said wire receiving hole.

In a further aspect, a method for reducing crosstalk between contacts in an electrical connector for signals above 250 MHz is provided. The method comprises providing a printed circuit board (PCB), having an opening therethrough, the opening dimensioned to accept insertion of at least a portion of a mating electrical connector, and configuring the PCB with a plurality of contacts that extend into the opening, each said contact configured to make non-linear physical contact with respective contacts of the mating electrical connector.

DETAILED DESCRIPTION OF THE INVENTION

Figure 1:
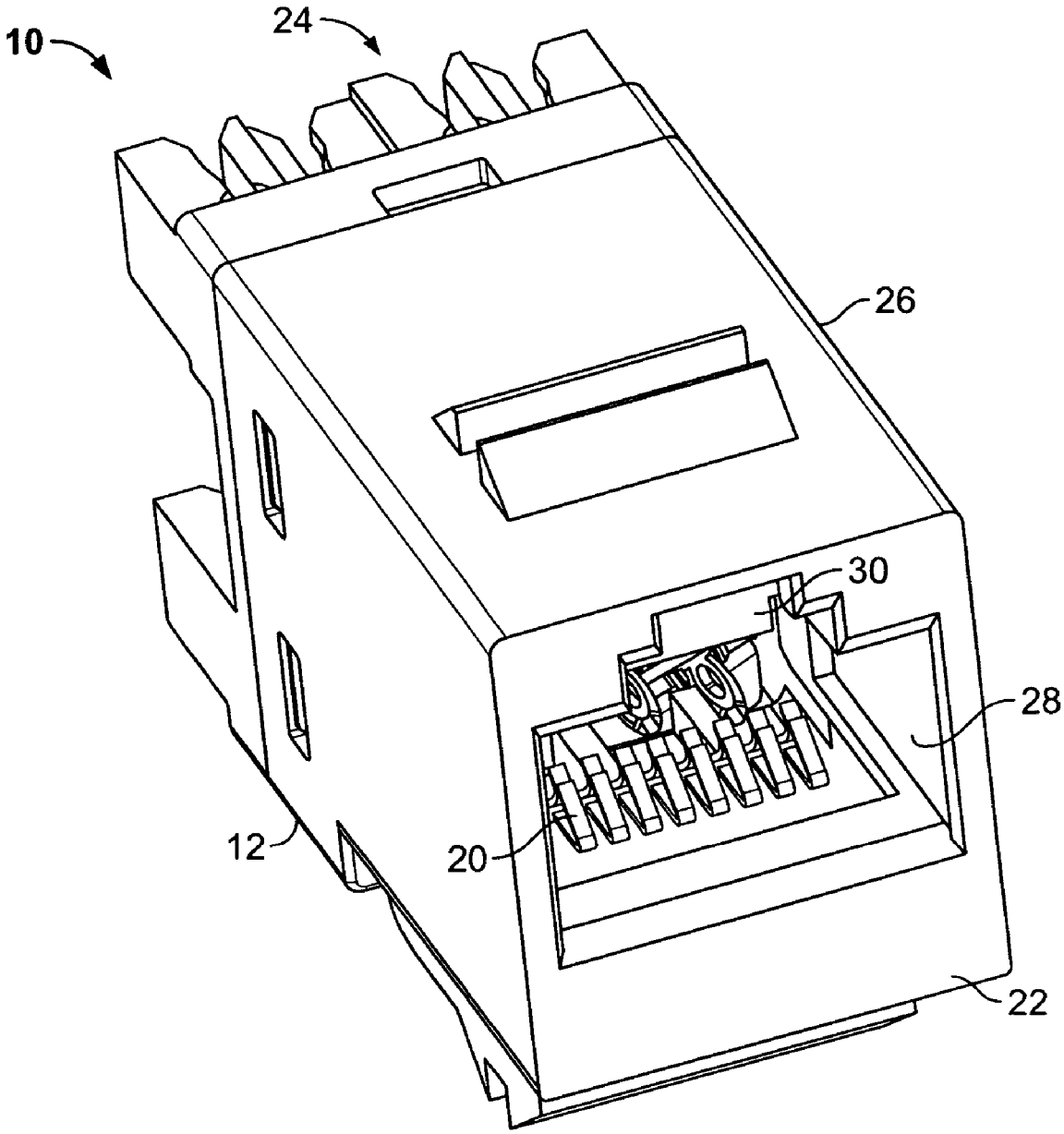
FIG. 1 is a perspective view of an electrical connector formed in accordance with an exemplary embodiment of the present invention.

FIG. 1 is a perspective view of an electrical connector 10 formed in accordance with an exemplary embodiment of the present invention. In the embodiment, electrical connector 10 is configured as a jack 12. The jack 12 may be mounted on a wall or panel, or, alternatively, may be mounted in an electrical device or apparatus having a communications port through which the device may communicate with other external networked devices. In addition, the jack 12 may be configured as an in-line device, where jack 12 and plug 14 (shown in FIG. 2) are utilized to connect two cables. The electrical connector (e.g., jack 12) will be described in terms of an assembly having eight discrete contacts 20 within that are accessible from a mating end 22 to provide contact with wires (not shown) from a wire receiving end 24 of a housing 26 of the jack 12. In at least one embodiment, the eight discrete contacts are to be configured as four differential pairs. The contacts 20 are accessed through an opening 28 in the mating end 22 of the housing 26. A locking mechanism 30 extends into opening 28 that is configured to engage a portion of the plug 14 to retain the plug 14 within the jack 12.

It is to be understood that the benefits described herein are also applicable to other connectors carrying fewer or greater numbers of contacts in alternative embodiments. The following description is therefore provided for illustrative purposes only and is but one potential application of the inventive concepts herein. As further described herein, contacts 20 are mounted on a printed circuit board (PCB) that is fixed in position with respect to the housing 26. The contacts may includes one or more pairs of contacts 20 configured as differential pairs.

Figure 2:
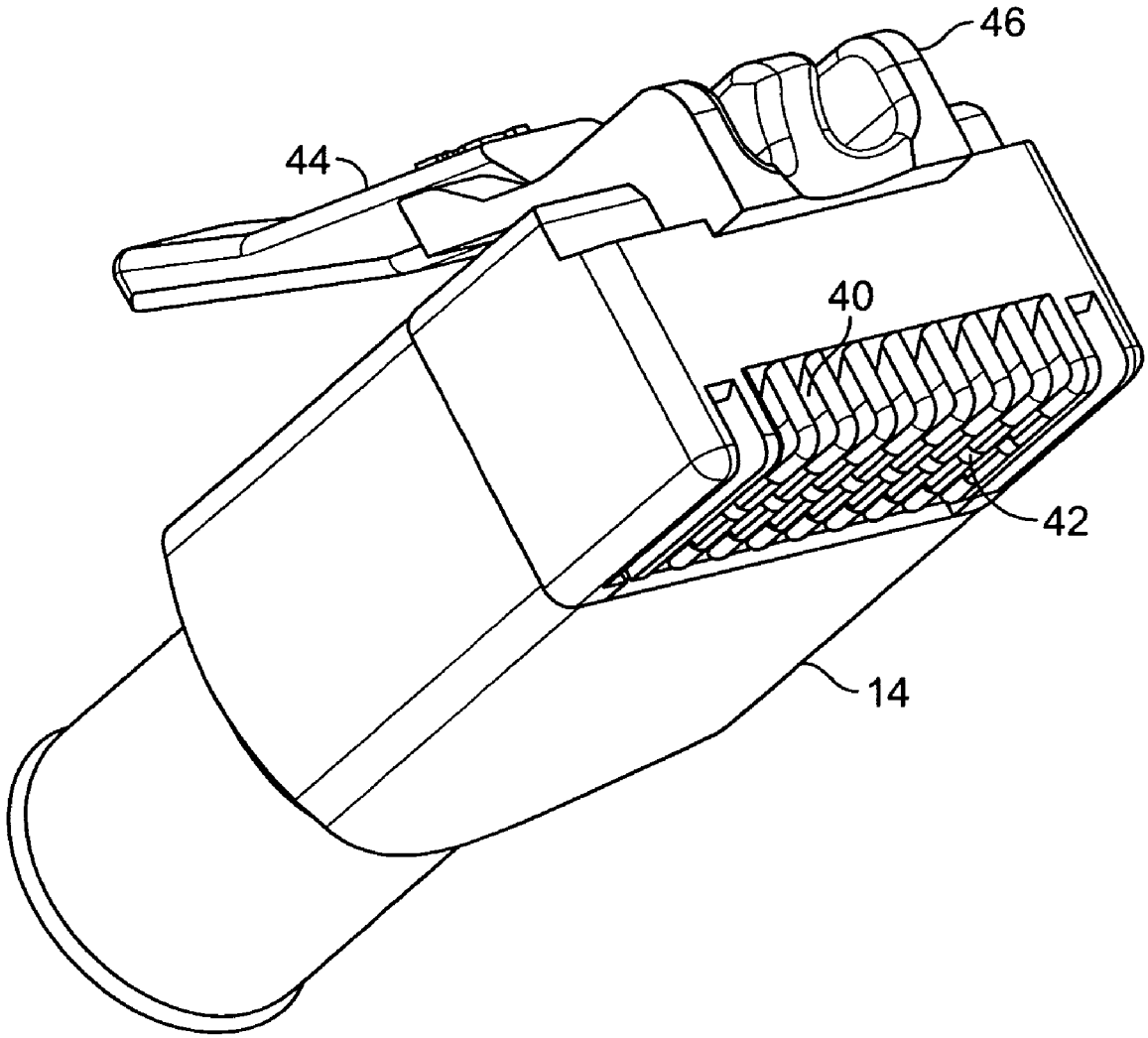
FIG. 2 is a perspective view of a connector configured to mate with the electrical connector shown in FIG. 1.

FIG. 2 is a perspective view of the plug 14 that is configured to mate with the jack 12. As can be ascertained from FIG. 2, plug 14 has a substantially similar cross section as opening 28 of the jack 12 as it engages the opening 28. The plug 14 includes a plurality of channels 40 formed therein with one contact 42 located in each of the channels 40. Each contact 42 is configured to make electrical contact with one of contacts 20 when the plug 14 is inserted into the jack 12. The plug 14 is configured with a connector latch lever 44 for latching the plug 14 to the jack 12, utilizing the locking mechanism 30 within the jack 12 as will be described. The connector latch lever 44 extends from a connector latch molding 46 that is formed as part of the body of plug 14.

Figure 3:
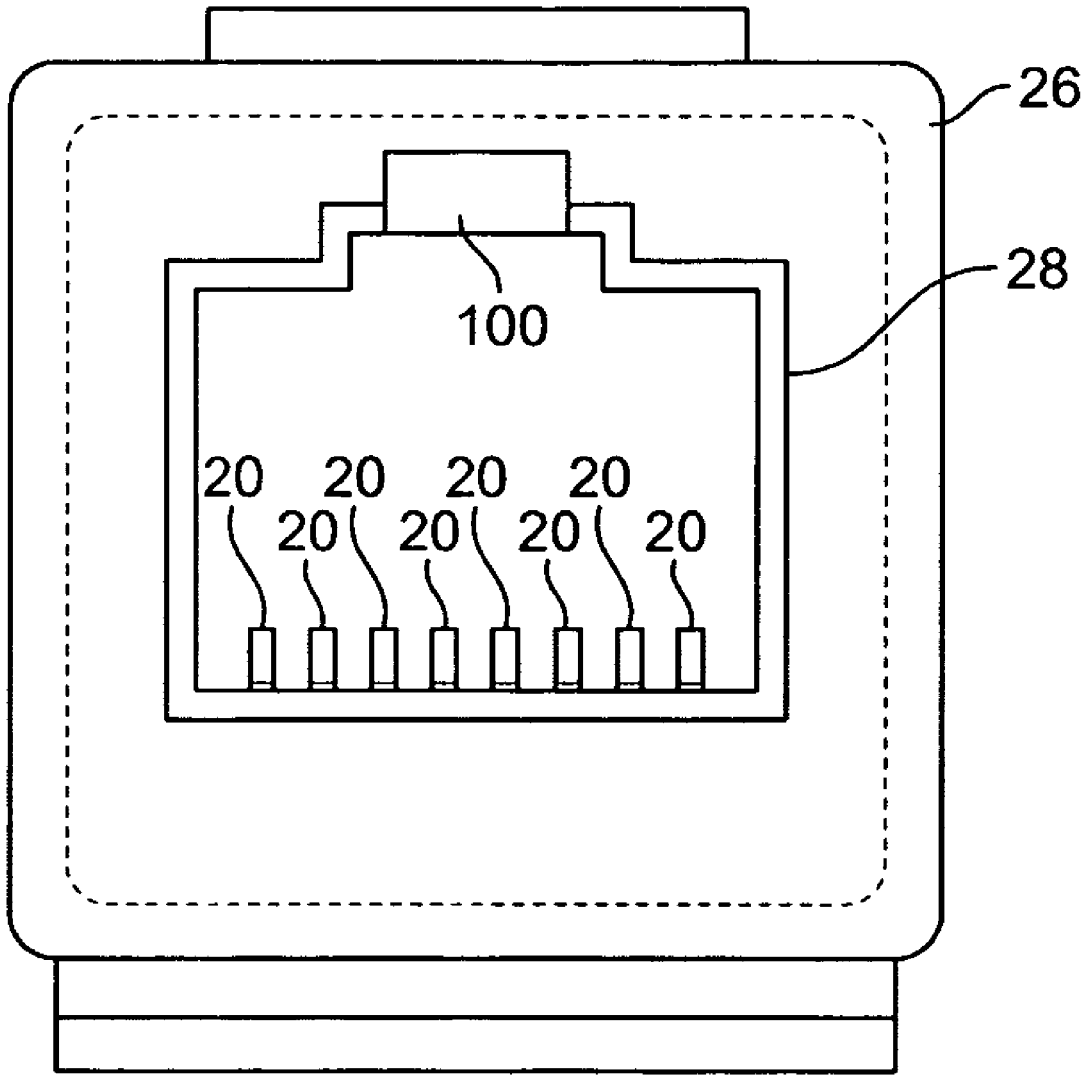
FIG. 3 is a mating end view of the electrical connector of FIG. 1.

FIG. 3 is a mating end view of the jack 12. As viewed through opening 28, a printed circuit board (PCB) 100 is substantially vertically mounted, with respect to opening 28, within the housing 26. An outline of PCB 100 is illustrated, partially in phantom view, and in one embodiment, housing 26 is molded to retain PCB 100 in such a position. The contacts 20 of jack 12 are shown as being mounted on PCB 100 and are further explained below.

Figure 4:
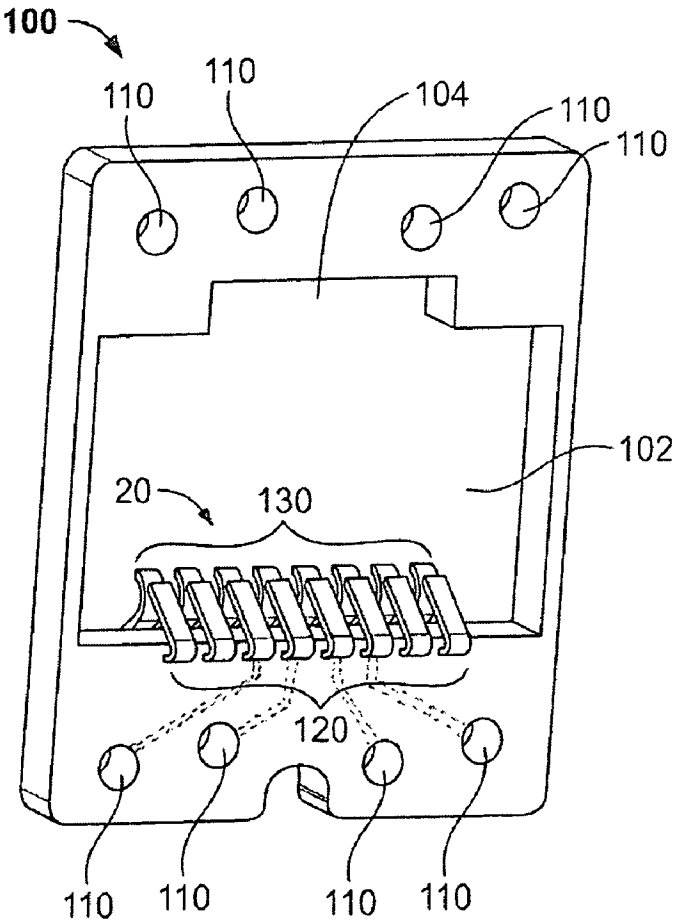
FIG. 4 is a frontal view of a printed circuit board (PCB) configured to be installed within a housing of the electrical connector of FIG. 1.

FIG. 4 is a frontal view of PCB 100 configured to be installed within the housing 26 of the jack 12. As illustrated, PCB 100 is configured with a plug opening 102 therethrough which allows at least a portion of plug 14 to pass through. The plug opening 102 also includes a latch molding engaging portion 104 which is configured to allow at least a portion of the connector latch molding 46 of plug 14 to pass through. Insertion of the plug 14 into the PCB 100, along with the engagement of latch molding engaging portion 104 and connector latch molding 46 and the engagement of the connector latch lever 44 with jack 12 provides improved stability to the physical connection between jack 12 and plug 14 as compared to previously known plug and jack configurations, at least in part because the plug 14 engages both the PCB 100, as described herein, and the housing 26 of the jack 12.

The PCB 100 further includes a plurality of contact receiving holes 110 configured for the insertion of an electrical conductor, for example, a compliant pin or other solder contact. In one embodiment, contact receiving holes 110 are plated through and configured for the connection of a compliant pin contact. In one embodiment, the PCB 100 is a multiple layer circuit board and, though not shown in FIG. 3, the PCB 100 is configured with a plurality of conductive traces that extend from a respective one of the contacts 20, to a respective contact receiving hole 110. In an embodiment, these conductive traces are sized and routed in a configuration to reduce or eliminate any crosstalk that might occur between the contacts 20 as a result of engagement of those contacts 20 with a respective contact 42 of plug 14. More specifically, the conductive traces may be oriented within the PCB 100 to limit an amount of crosstalk between signals conducted through the traces.

Figure 5:
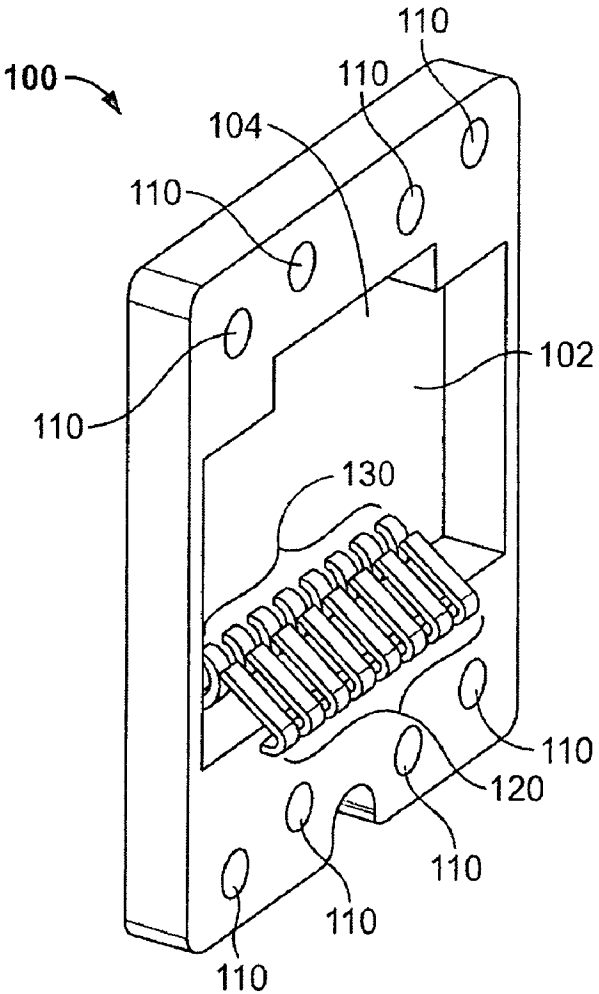
FIG. 5 is a perspective view of the PCB shown in FIG. 4.

FIG. 5 is a perspective view of PCB 100. In the view of FIG. 5 it is shown that there are two contacts 20 attached to PCB 100 for each contact 42 of plug 14. However, in alternative embodiments, there may be a single contact 20 for each contact 42. In the embodiment shown in FIG. 5, to distinguish, contacts 20 are sometimes referred to herein as forward contacts 120 and rearward contacts 130. A single forward contact 120 and single rearward contact 130 are sometimes referred to as a contact set. For each contact set, one of the contacts 120, 130 is configured to operate as a signal contact and the other contact 120, 130 of the contact set is configured to operate as a compensation contact. Multiple configurations of signal contacts and compensation contacts are possible. In one embodiment, all forward contacts are configured as signal contacts and in another, all rearward contacts are configured as the signal contacts. In further embodiments, combinations of forward contacts and rearward contacts as signal contacts are contemplated as long as each contact set includes both a signal contact and a compensation contact. Those contacts configured as signal contacts are the contacts from which the above described conductive traces extend, extending to the respective contact receiving hole 110 as above described.

Some or all of the compensation contacts will electrically connect to one or more compensation elements (not shown) located on PCB 100. The compensation elements are selected to provide a desired noise compensation to the respective signal contacts. Additional conductive traces (not shown) may extend from the contacts configured as compensation contacts. These additional conductive traces are configured to provide one or more of a reactance, a ground plane, and shielding to PCB 100 as further described below in order to improve the integrity of the signals passing to the respective signal contact. These conductive traces are generally referred to herein as compensation elements.

More specifically, the compensation elements are selected to provide a desired crosstalk compensation to counteract crosstalk at the contacts 42 in the plug 14 through direct contact of the compensation contacts with the plug contacts 42. From the perspective of the jack 12, the plug contacts 42 and the wires (not shown) extending through plug 14 are considered to be a noise source, or more specifically, a source of crosstalk. Thus, in applying compensation directly to the plug contacts 42, the crosstalk compensation is applied to the source of the crosstalk.

In one embodiment, the compensation elements include a conductive element that provides a reactance that is configured to counteract the crosstalk that may be present within the plug 14. In an exemplary embodiment, the reactance primarily includes a capacitance. The compensation elements may be formed using techniques well known in the art, for example, capacitive coupling, for such purposes. For example, two or more compensation contacts may be placed in close proximity to each other so as to create the reactance to counteract the crosstalk. Another method may include placing conductors on the PCB 100 in close proximity to one another, such as interlaced or aligned copper pours. A third method may include placing discrete chips such as a capacitor on the PCB 100 in contact with the conductive traces. The compensation elements may also include other circuit components that create a coupling to counteract the crosstalk within the plug 14.

In alternative embodiments, contacts 120 and 130 are attached to PCB 100 using at least one of a compliant pin process, a solder process and a clip-on process. As described above, contacts 120 and 130 are configured to engage (e.g., make electrical contact), with the contacts 42 of plug 14 upon its insertion into jack 12. However, a shape, location, and orientation of contacts 120 and contacts 130 is believed to be different than that of contacts utilized in known jacks, and, as further explained, results in a reduced electrical path length for the signals traveling between contacts 42 and contacts 120 and 130. In known jack and plug configurations, the contacts are substantially rectangular and elongated, and result in a comparatively long electrical path for the signals through the contacts of the plug and jack before any signal compensation can be applied. In the embodiments described herein, the electrical path length for signals traveling through contacts 42 and 20, from contact to PCB 100 is greatly reduced at compared to known plug and jack configurations. As such, electrical delays are reduced and the variations in impedance that occur with the longer electrical path lengths in known jack and plug configurations are avoided. In a preferred embodiment, contact between plug contacts 42 and contact 20 of the jack occur in the plane of PCB 100. As used herein, the phrase "within the plane of the PCB" refers to an area that is bounded by the dimensions of opening 102, and the front and back surfaces of the PCB 100.

Figure 6:
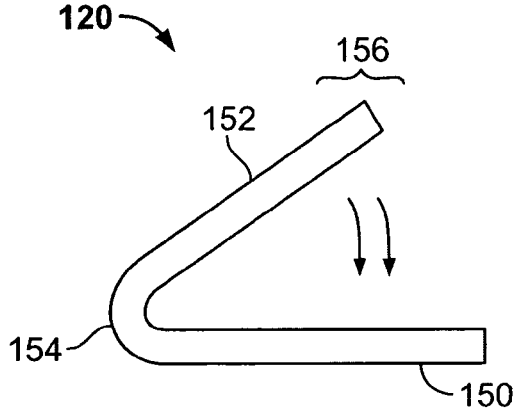
FIG. 6 is a side view of a forward contact configured to extend from the PCB of FIG. 4.

FIG. 6 is a side view of forward contact 120. Contact 120 includes a PCB engaging member 150 that engages the PCB 100, for example, by soldering or other attaching methods. As the plug 14 is inserted into the jack 12, the contacts 42 of plug 14 engage a plug contact engaging member 152 of contact 120. The engagement causes the plug contact engaging member 152 to flex downward, as indicated by the arrows. A flexing portion 154 between the plug contact engaging member 152 and the PCB engaging member 150 allows the downward movement of the top portion and further allows the plug contact engaging member 152 to spring back to an original position when the plug 14 is removed from the jack 12. Together, the PCB engaging member 150, the plug contact engaging member 152, and the flexing portion 154 result in a "V" shaped contact with one end of the "V" attached to the PCB 100. The configuration of forward contact 120 is such that area 156 of the forward contact 120, which is within the plane formed by PCB 100, makes physical contact with the contact 42 of plug 14. This configuration, as above described, reduces the electrical path length between the mating point of forward contact 120 and plug contact 42 and the compensation available within PCB 100. Such a configuration reduces the possibilities for crosstalk to occur between adjacent signal contacts, at least as compared to known plug and jack contact configurations.

Figure 7:
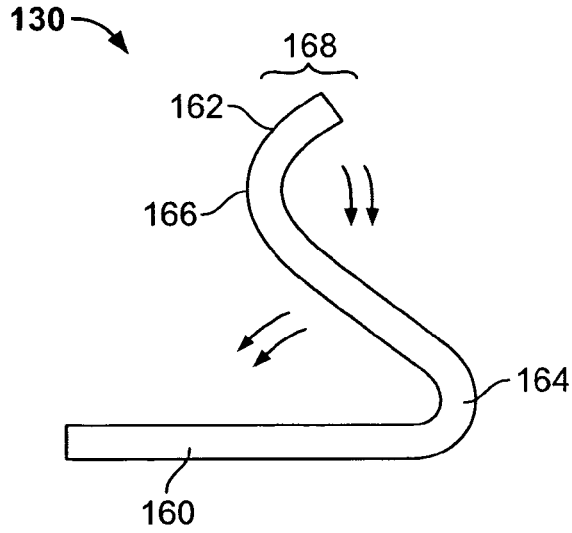
FIG. 7 is a side view of a rearward contact configured to extend from the PCB of FIG. 4.

FIG. 7 is a side view of rearward contact 130. Contact 130 includes a PCB engaging member 160 that engages the PCB 100, for example, by soldering or other attaching methods. As the plug 14 is inserted into the jack 12, the contacts 42 of plug 14 engage a top portion 162 of contact 130. The engagement causes the plug contact engaging member 162 to flex downward and bend slightly, as indicated by the arrows. A first flexing portion 164 between the plug contact engaging member 162 and the PCB engaging member 160 allows the downward movement of the plug contact engaging member 162 and further allows the plug contact engaging member 162 to spring back to an original position when the plug 14 is removed from the jack 12. The plug contact engaging member 162 also includes a second flexing member 166 that allows the above described slight bending. Overall the rearward contact 130 has an "S" shape as above described which allows the flexure at the first flexing member 164 and the second flexing member 166. The configuration of rearward contact 130 is such that area 168 of the plug contact engaging member 162 of the contact 130 makes physical contact with the contact 42 of plug 14 also within the plane formed by PCB 100 resulting in the benefits (e.g., reduced crosstalk) of reduced electrical path lengths as described above.

Figure 8:
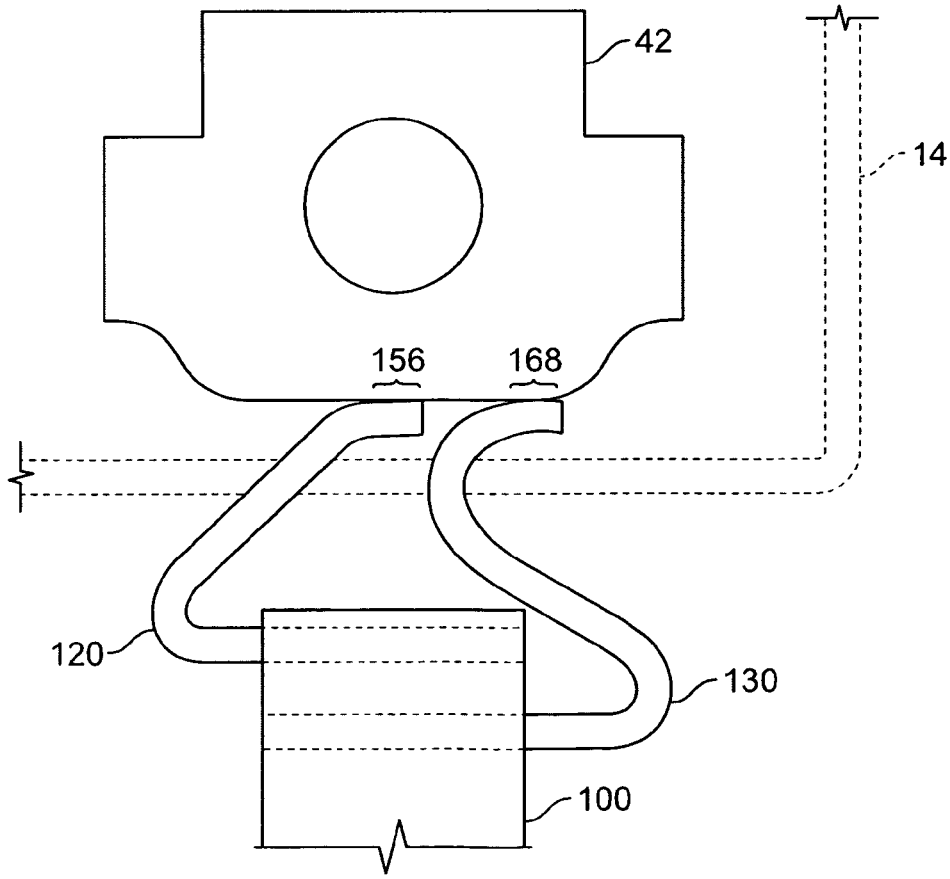
FIG. 8 is a side view illustrating contact between the forward contact of FIG. 6 and the rearward contact of FIG. 7 with a plug contact.

FIG. 8 is a side view illustrating contact between the forward contact 120 and the rearward contact 130 with contact 42 of plug 14. For reference, a portion of PCB 100 is shown along with a portion of plug 14. As described above, the contact within the plane formed by PCB 100 (e.g., at area 156 of contact 120 and area 168 of contact 130 respectively) reduces crosstalk between the multiple contacts 120 and also between the multiple contacts 130 as the signals are quickly routed to the PCB 100 for compensation. Known Category 6 contact interfaces are only required to be operable (e.g., maintain signal integrity) to about 250 MHz. However, by utilization of jack 12 and 14 and the contacts 120 and 130 therein, the contact engagement within the plane of PCB 100, resulting in the described reduction in electrical path length for the signals, is operable at frequencies above 250 MHz. (e.g, 500 MHz and beyond). In addition, some contact configurations in known jack and plug configurations, specifically RJ-45 jack and plug configurations are in excess of ½ inch and up to 1 inch in length before any compensation is encountered which adds to the problems associated with crosstalk. Utilization of PCB 100 and contacts 120 and 130, in one embodiment, reduce the length between the contact mating area and the compensation available within PCB 100 to about 0.25 inch to about 0.35 inch. This reduction in electrical path length results in a reduced time delay and reduction in impedance variations before compensation techniques are applied to the signals to and from plug 14. PCB 100 may also include circuitry and shielding that can affect electromagnetic performance of the signals passing through as plug 14 is configured to at least partially pass through the PCB 100.

Such a configuration also allows an overall length of jack 12 to be reduced from known jack and plug embodiments. Utilization of PCB 100 also provides a physically stronger and more stable interconnection between jack 12 and plug 14 than is accomplished in previous configurations, in part because the plug 14 engages both the PCB 100 and the housing 26 of the jack 12. In one embodiment, housing 26 is formed, typically molded with a PCB carrier therein. The PCB carrier is typically a channel formed around an interior perimeter of housing 26 to retain PCB 100. In a typical embodiment, housing 26 is formed in two pieces which allows for the easy insertion of PCB 100 into housing 26.

While the invention has been described in terms of various specific embodiments, those skilled in the art will recognize that the invention can be practiced with modification within the spirit and scope of the claims.

What is claimed is:

1. An electrical connector comprising:

a housing comprising a mating end and a wire receiving end;

a printed circuit board (PCB) mounted within said housing, said PCB comprising a first side and a second side and an opening formed therethrough, wherein said opening configured to receive a second electrical connector configured to mate with said electrical connector; and a plurality of contacts configured to extend from said PCB into said opening, a first of said plurality of contacts extending from said first side of said PCB and a second of said plurality of contacts extending from said second side of said PCB, said first and second contacts converging toward one another such that said first and second contacts are located in the opening within a plane formed by said PCB.

2. The electrical connector of claim 1 wherein said plurality of contacts comprise a first plurality of signal contacts and a second plurality of compensation contacts.

3. The electrical connector of claim 1 wherein said PCB comprises:

a plurality of circuit traces formed therein; and a plurality of contact receiving holes formed therein, at least a portion of said circuit traces extending from a respective contact to a respective contact receiving hole.

4. The electrical connector of claim 1 wherein said electrical connector comprises an RJ-45 jack and said opening in said PCB is configured to receive and retain an RJ-45 series plug.

5. The electrical connector of claim 1 wherein said PCB comprises:

a plurality of circuit traces formed therein, said circuit traces oriented within said PCB to create a reactance therebetween to limit an amount of crosstalk between the signals to be conducted through said traces; and a plurality of contact receiving holes formed therein, at least a portion of said circuit traces extending from a respective contact to a respective contact receiving hole.

6. The electrical connector of claim 1 wherein at least a portion of said contacts are configured to engage respective contacts of the second electrical connector configured to mate with said electrical connector, said contacts configured such that the engagement between said contacts and the respective contacts is within a plane of said PCB.

7. The electrical connector of claim 1 wherein a portion of said plurality of contacts each comprises:

a substantially linear PCB engaging member;

a substantially linear plug contact engaging member; and a flexing portion connecting said PCB engaging member and said plug contact engaging member, said members forming a substantially V-shaped contact, a portion of said plug contact engaging member configured to make physical contact with a contact of a plug within said opening of said PCB.

8. The electrical connector of claim 1 wherein a portion of said plurality of contacts each comprises:

a substantially linear PCB engaging member;

a plug contact engaging member;

a first flexing member adjacent said PCB engaging member;

a second flexing member adjacent said plug contact engaging member and attached to said first flexing member, said members forming a substantially S-shaped contact, a portion of said plug contact engaging member configured to make physical contact with a contact of a plug within said opening of said PCB.

9. The electrical connector of claim 1 wherein said housing is molded to retain said PCB in a substantially vertical orientation, said mating end of said housing aligned with said opening in said PCB.

10. The electrical connector of claim 1 wherein said opening in said PCB is configured to engage a connector latch molding of the second electrical connector.

11. The electrical connector of claim 1 wherein the second electrical connector includes plug contacts, said plurality of contacts comprise signal contacts and compensation contacts, a single signal contact cooperating with a single compensation contact as a contact set, each plug contact engaging said contacts of a respective contact set.

12. The electrical connector of claim 1 wherein the second electrical connector includes plug contacts, said plurality of contacts comprise compensation contacts configured to directly engage corresponding ones of the plug contacts.

13. A printed circuit board (PCB) configured for placement within a housing of an electrical connector, said PCB comprising:

an opening formed therethrough within a plane defined by the PCB and dimensioned to receive a portion of a second electrical connector along a mating axis perpendicular to the plane defined by the PCB; and a plurality of contacts attached to said PCB and configured to extend into said opening, said contacts being oriented non-parallel with respect to the mating axis, at least a portion of the plurality of contacts comprise compensation contacts, each of said contacts directly engage contacts of the second electrical connector within the opening.

14. The PCB of claim 13 further comprising:

a plurality of circuit traces formed therein; and a plurality of contact receiving holes formed therein, a first portion of said circuit traces extending from a respective contact to a respective contact receiving hole, a second portion of said circuit traces configured to provide compensation to signals passing through said PCB.

15. The PCB of claim 13 further comprising a plurality of circuit traces formed therein, said circuit traces oriented within said PCB to provide electrical compensation therebetween to limit an amount of crosstalk between the signals to be conducted through said PCB.

16. The PCB of claim 15 wherein the electrical compensation includes one or more of a reactance, shielding, a ground plane, interlaced copper traces, and an aligned copper pour.

17. The PCB of claim 13 wherein a portion of said plurality of contacts each comprise:

a substantially linear PCB engaging member;

a substantially linear plug contact engaging member; and a flexing portion connecting said PCB engaging member and said plug contact engaging member, said members forming a substantially V-shaped contact, a portion of said plug contact engaging member configured to make physical contact with a contact of an electrical connector inserted into said opening of said PCB.

18. The PCB of claim 13 wherein a portion of said plurality of contacts each comprise:

a substantially linear PCB engaging member;

a plug contact engaging member;

a first flexing member adjacent said PCB engaging member;

a second flexing member adjacent said plug contact engaging member and attached to said first flexing member, said members forming a substantially S-shaped contact, a portion of said plug contact engaging member configured to make physical contact with a contact of an electrical connector inserted into said opening of said PCB.

19. The PCB of claim 13 wherein said opening in said PCB is configured to engage at least a portion of a connector latch molding of the second electrical connector.

20. An RJ-45 connector jack comprising:

a housing comprising a mating end, said mating end comprising an opening, said housing and said opening defining an RJ-45 mating envelope configured to receive an RJ-45 plug having plug contacts;

a printed circuit board (PCB) mounted within said housing, said PCB comprising a first side and a second side and an opening formed therethrough defining an RJ-45 mating envelope configured to receive the RJ-45 plug, said housing configured to retain said PCB such that said PCB opening and said housing opening are aligned for insertion of the RJ-45 plug; and a plurality of contacts configured to extend from said PCB and into said PCB opening, said PCB opening configured to receive a portion of the RJ-45 plug such that each said contact is configured to form an electrical connection with a corresponding plug contact within a plane defined by the PCB;

wherein a first set of said plurality of contacts are cantilevered from said first side and bent toward said PCB opening, a second set of said plurality of contacts are cantilevered from said second side and bent toward said PCB opening, said contacts configured such that converge toward one another within said PCB opening.

21. The connector jack of claim 20 wherein said PCB comprises a plurality of circuit traces formed therein, at least a portion of said circuit traces oriented within said PCB to create compensation therebetween that is effective to limit an amount of crosstalk between the signals to be conducted through said PCB.

* * * * *